US005090181A

United States Patent [19]

Foster et al.

[11] Patent Number: 5,090,181

[45] Date of Patent: Feb. 25, 1992

[54] APPARATUS FOR TRANSPORTING AND REORIENTING ENVELOPES

[75] Inventors: Dean H. Foster, Stratford; Hans C. Mol, Wilton, both of Conn.

[73] Assignee: Pitney Bowes Inc., Stamford, Conn.

[21] Appl. No.: 620,870

[22] Filed: Dec. 3, 1990

[51] Int. Cl.[5] ..... B65B 5/04

[52] U.S. Cl. ..... 53/569; 53/284.3; 53/381.7

[58] Field of Search ..... 53/569, 284.3, 460, 53/206, 381.7, 381.5; 493/245, 453; 271/251, 248

[56] References Cited

U.S. PATENT DOCUMENTS

| | | | |
|---|---|---|---|
| 3,858,381 | 1/1975 | Huber et al. | 53/569 |
| 4,020,615 | 5/1977 | Irvine et al. | 53/284.3 X |
| 4,333,300 | 6/1982 | Russell | 53/569 |
| 4,649,691 | 3/1987 | Buckholz | 53/284.3 |

*Primary Examiner*—James F. Coan

*Attorney, Agent, or Firm*—Donald P. Walker; David E. Pitchenik; Melvin J. Scolnick

[57] ABSTRACT

Apparatus for transporting an evelope including a body having opposed front and back wall portions defining a bottom edge, wherein the envelope includes a flap wall portion extending from the front wall portion and defining therewith a crease edge extending parallel to the bottom edge for folding the flap wall portion in overlaying relationship with the back wall portion, and wherein the front and back wall portions define parallel-spaced side edges extending between the crease and bottom edges, the apparatus comprising: first structure for conveying the envelope in a first direction wherein the front and flap wall portions thereof are upwardly oriented, the first conveying structure including first structure for aligning one envelope side edge in the first direction; second structure for conveying the envelope in a second direction wherein the front and flap wall portions thereof are downwardly oriented, the second conveying structure including second structure for aligning the one envelope side edge in the second direction; and structure for reorienting the envelope, the reorienting structure including structure for guiding the envelope through a curvedly-extending path of travel wherein the upwardly oriented front and flap wall portions are progressively downwardly oriented, the reorienting structure including first structure for feeding the envelope from the first conveying structure to the guiding structure, and the reorienting structure including second structure for feeding the envelope from the guiding structure to the second conveying structure.

36 Claims, 2 Drawing Sheets

APPARATUS FOR TRANSPORTING AND REORIENTING ENVELOPES

BACKGROUND OF THE INVENTION

This invention is generally concerned with envelope transporting apparatus and more particularly with apparatus for transporting an envelope including structure for reorienting the envelope.

As shown in U.S. Pat. No. 1,680,044 for a Paper Handling Machine, issued Aug. 7, 1928 to R. Hitchcock, sheet conveying structures which include a plurality of elongate, parallel-spaced, rollers for feeding sheets into engagement with a registration fence, have been provided with a row of a idler balls, each of which is supported in overhanging relationship with one of the feed rollers, for urging the sheets into feeding engagement with the rollers. Moreover, as shown in U.S. Pat. No. 1,469,168 for a Sheet Turning Device, issued Sept. 25, 1923 to J. A. Mets, provision has been made for feeding respective sheets into an arcuate slot, extending at an angle to the path of travel of the sheets, to turn the sheets at right angles to the path of travel.

It has been found that in order to minimize the likelihood of feeding more than one envelope at a time from a stack of envelopes, the envelopes are preferably oriented such that the front, or address, wall portion of the body of the envelope is oriented upwardly, with the flap wall portion extending generally horizontally therefrom, and the envelopes are preferably fed from the stack in a manner such that the bottom edge of the body of the envelope, i.e., the edge opposite the flap wall portion, is the leading edge and the flap wall portion trails the body. On the other hand, when such envelopes are to be stuffed with inserts in the course of assembling a mailpiece, it is preferable that both the front and flap wall portions of the envelope be oriented downwardly to facilitate separation of the front and back wall portions of the body of the envelope and stuffing inserts therein.

Accordingly:

An object of the invention is to provide envelope transporting apparatus including structure for reorienting an envelope; and Another object is to provide structure for transporting envelopes fed thereto and reorienting the envelopes to facilitate stuffing inserts therein.

SUMMARY OF THE INVENTION

Apparatus for transporting an envelope including a body having opposed front and back wall portions defining a bottom edge, wherein the envelope includes a flap wall portion extending from the front wall portion and defining therewith a crease edge extending parallel to the bottom edge for folding the flap wall portion in overlaying relationship with the back wall portion, and wherein the front and back wall portions define parallel-spaced side edges extending between the crease and bottom edges, the apparatus comprising: first means for conveying the envelope in a first direction wherein the front and flap wall portions thereof are upwardly oriented, the first conveying means including first means for aligning one envelope side edge in the first direction; second means for conveying the envelope in a second direction wherein the front and flap wall portions thereof are downwardly oriented, the second conveying means including second means for aligning the one envelope side edge in the second direction; and means for reorienting the envelope, the reorienting means including means for guiding the envelope through a curvedly-extending path of travel wherein the upwardly oriented front and flap wall portions are progressively downwardly oriented, the reorienting means including first means for feeding the envelope from the first conveying means to the guiding means, and the reorienting means including second means for feeding the envelope from the guiding means to the second conveying means.

BRIEF DESCRIPTION OF THE DRAWINGS

As shown in the drawings, wherein like reference numerals designate like or corresponding parts throughout the several views.

DESCRIPTION OF THE PREFERRED EMBODIMENTS

Figure 1:
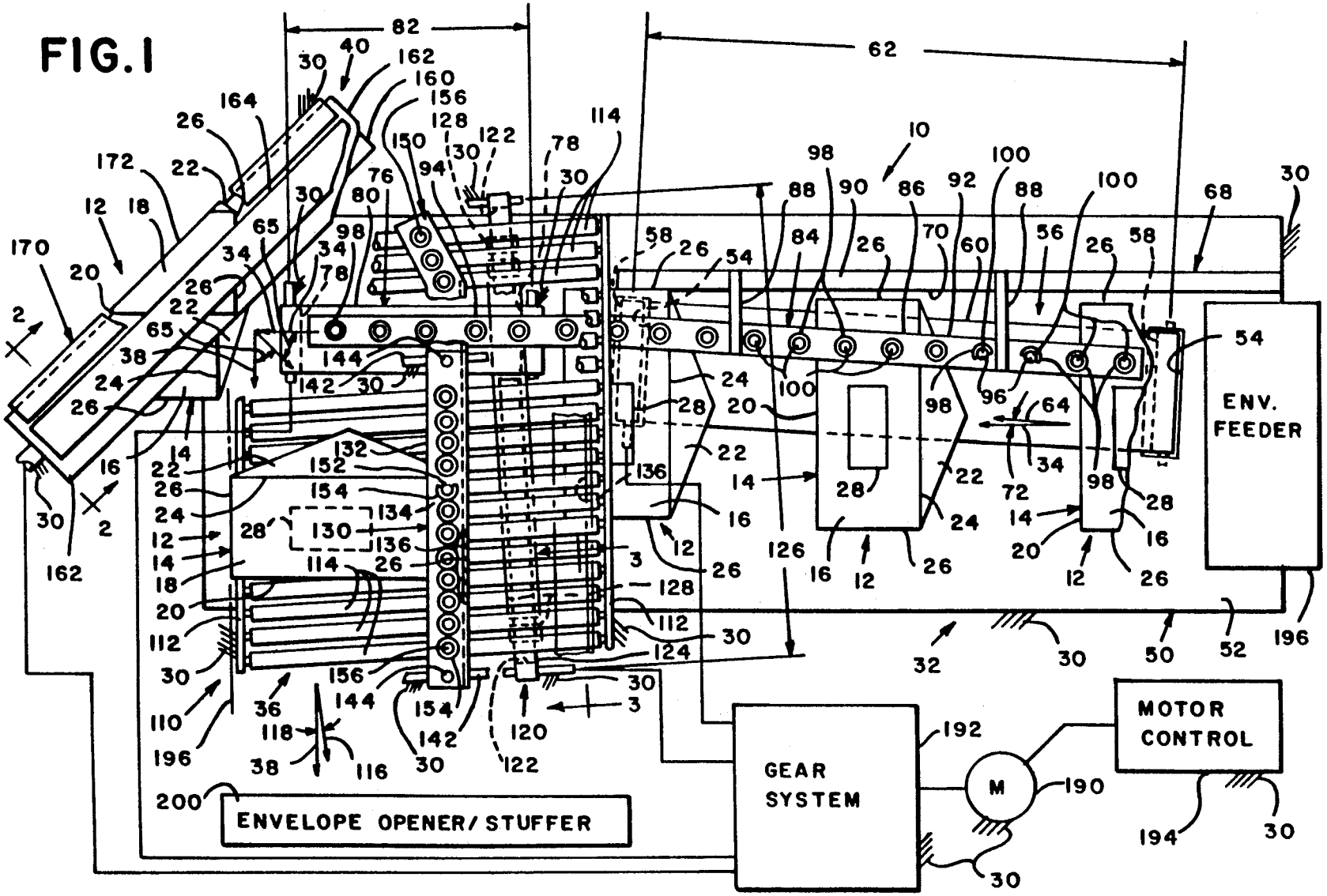
FIG. 1 is a partially schematic, perspective, view of envelope transporting apparatus according to the invention.

As shown in FIG. 1, according to the invention there is provided apparatus 10 for transporting a typical envelope 12.

The envelope 12 (FIG. 1) generally includes a horizontally-extending body 14 having a front, or address, wall portion 16, and, opposite thereto, a back wall portion 18, which together define a bottom fold edge 20. The envelope 12 also includes a flap wall portion 22, which horizontally extends from the front wall portion 16 and defines therewith a crease edge 24, which extends parallel to the bottom edge 20, for folding the flap wall portion 22 toward and into overlying relationship with the back wall portion 18. Moreover the envelope 12 includes opposed, parallel-spaced, side fold edges 26, defined by the front and back wall portions, 16 and 18, which extend between the bottom and crease edges 20 and 24. And, for illustration purposes, the envelope 12 is shown as including a conventional window 28 formed in the front wall portion 16 of the envelope 12.

Figure 2:
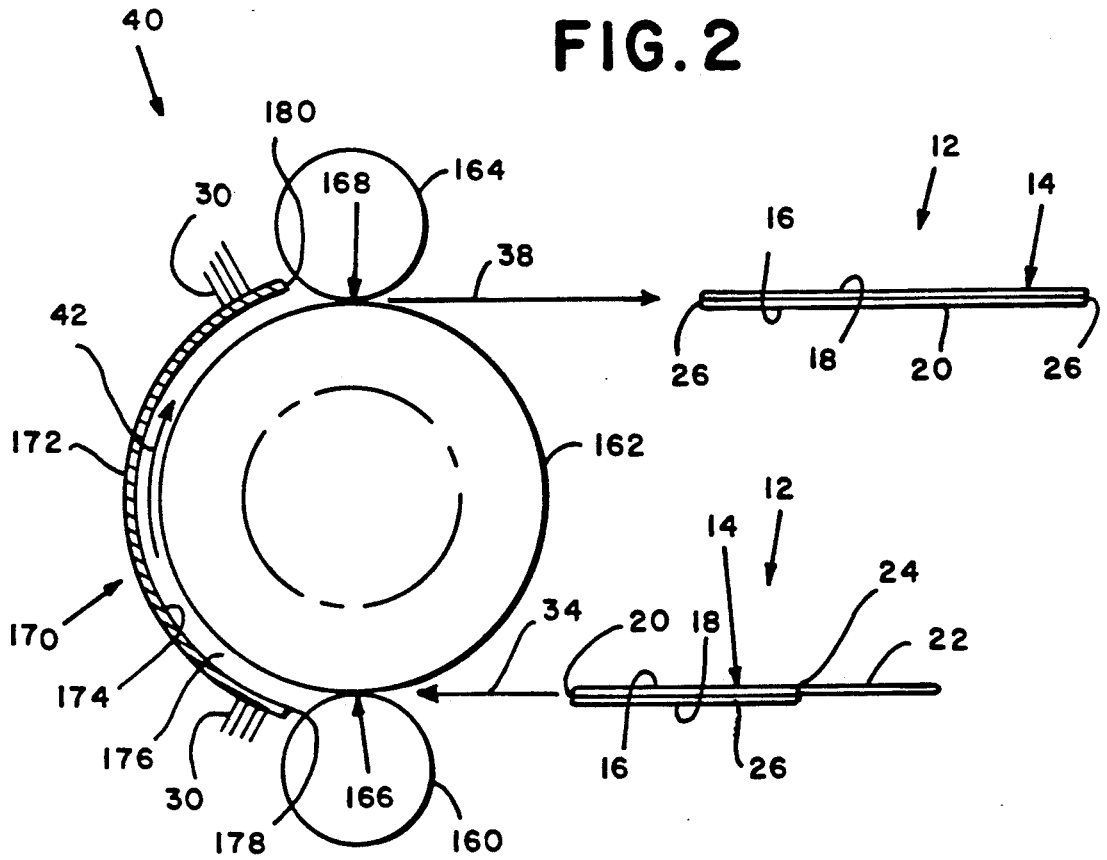
FIG. 2 is an elevation view, taken substantially along the line 2—2 of FIG. 1, showing structure for reorienting an envelope fed thereto.

The envelope transporting apparatus 10 (FIG. 1) generally includes framework 30, for supporting the various components of the apparatus 10 and includes first envelope conveying structure 32, for feeding an envelope 12 in a first direction 34, wherein the envelope's front and flap wall portions, 16 and 22, are upwardly oriented. In addition, the apparatus 10 generally includes second envelope conveying structure 36 for feeding the envelope 12 in a second direction 38, wherein the envelope's front and flap wall portions, 16 and 22, are downwardly oriented. And, the apparatus 10 generally includes envelope reorienting structure 40 for feeding the envelope 12 from the first conveying structure 32, through a curvedly-extending path of travel 42 (FIG. 2), wherein the upwardly oriented front and flap wall portions, 16 (FIG. 1) and 22, are progressively downwardly oriented, and to the second conveying structure 36.

The first envelope conveying structure 32 (FIG. 1) preferably includes an elongate, generally rectangularly-shaped deck 50, which is conventionally fixedly attached to the framework 30. The deck 50 has a horizontally-extending upper surface 52 and has a pair of elongate, parallel-spaced apertures 54 formed therein. In addition, the first conveying structure 32 comprises a first belt system 56, including a first pair of elongate, parallel-spaced, rollers 58, which are conventionally rotatably connected to the framework 30 beneath the respective deck apertures 54. The belt system 56 also includes a first endless belt 60 which is conventionally looped about and disposed in frictional engagement with the rollers 58, such that a first belt run 62 of the belt 60 extends through the deck apertures 54 and is disposed in sliding engagement with the deck's upper surface 52. As thus constructed and arranged, the belt run 62 is horizontally supported by the deck 50 for horizontally feeding envelopes 12 fed to the belt run 62 in a downstream path of travel 64 defined by the belt run 62.

In addition, the first envelope conveying structure 32 (FIG. 1) preferably comprises stationary, envelope-edge registration structure 68 including a conventional, elongate, upright, edge registration fence 70, which is coextensive in length with the deck 50 and is conventionally fixedly attached to the framework 30, for example as by means of connection to the deck 50, so as to extend downstream in the first direction 34, alongside the deck 50. Preferably, the first belt run 62 angularly extends downstream in the path of travel 64 toward the registration fence 70, and describes therewith, and thus with the first direction 34, an acute angle 72 of substantially three degrees. As thus constructed and arranged the belt run 62 urges one of the side edges 26 of each envelope 12 carried thereby into registration with the fence 70, thereby aligning the envelope 12 against the fence 70 for feeding in the first direction 34.

Further, downstream from the deck 50 (FIG. 1), and thus downstream from the registration fence 70, the first envelope conveying structure 32 comprises a second belt system 76, including a second pair of elongate, parallel-spaced, rollers 78, which are conventionally rotatably connected to the framework 30, beneath the level of the deck 50. The belt system 76 also includes a second endless belt 80 which is conventionally looped about and disposed in frictional engagement with the rollers 78, such that a second belt run 82 of the belt 80 horizontally extends downstream in the first direction 34, at the level of the first belt run 62, for receiving envelopes 12 fed thereto by the first belt run 62 and feeding the envelopes 12 downstream in the first direction 34.

Moreover, the first conveying structure 32 (FIG. 1) includes first structure 84 for urging respective envelopes 12 into engagement with each of the belt runs, 62 and 82. The envelope urging structure 84 includes a first elongate frame 86 which is conventionally supported by the framework 30 in overhanging relationship with the first and second belt runs, 62 and 82, for example as by means of a plurality of frame supporting arms 88 which extend from the frame 86 and are suitably connected to the upper edge 90 of the registration fence 70. The frame 86 includes an upstream leg 92, which extends downstream in the direction of the path of travel 64, and a downstream leg 94 which extends downstream, from the upstream leg 92, in the first direction 34. In addition, the frame 86 includes a plurality of apertures 96 formed therein at substantially equally spaced intervals longitudinally of the length thereof. Further, the first envelope urging structure 84 includes a plurality of collars 98, corresponding in number to the number of apertures 96, which are conventionally mounted within the respective apertures 96. And the first urging structure 84 includes a plurality of spherically-shaped idler balls 100, corresponding in number to the number collars 98, which are conventionally removably located within the respective collars 98 and rotatably held in place thereby in engagement with the belt runs, 62 and 82, therebeneath. As thus constructed and arranged, when the respective belt runs, 62 and 82, feed each envelope 12 downstream beneath the frame 86, the envelope 12 is serially fed beneath each idler ball 100 against the normal force exerted thereby on the envelope 12. As a result, the idler balls 100 tend to urge successive envelopes 12 into positive engagement with each of the belt runs, 62 and 82, independently of any difference there may be in the thickness of the envelopes 12. Moreover, the idler balls 100 within the collars 98 of the frame's upstream leg 92, tend to prevent envelopes 12 which are fed therebeneath and into engagement with the registration fence 70 from bouncing away from the fence 70 as they are carried downstream by the belt run 62. Thus the envelope urging structure 84 tends to promote accurate registration of successive envelopes 12 against the fence 70, and thus accurate alignment of the envelopes 12 in the first direction 34, as they are fed downstream by the first belt run 62.

Figure 3:
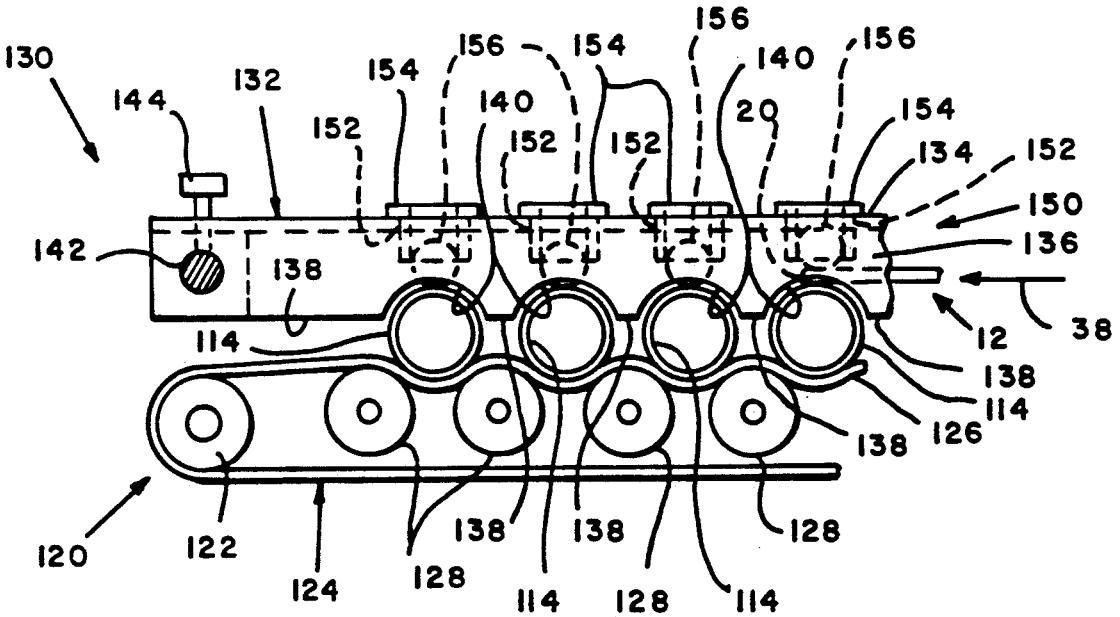
FIG. 3 is an elevation view, taken substantially along the line 3—3 of FIG. 1, showing the movable registration fence and feed roller table shown in FIG. 1.

The second envelope conveying structure 36 (FIG. 1) preferably comprises an elongate, generally rectangularly-shaped, roller-type, envelope feeding table 110, which is conventionally fixedly attached to the framework 30 so as to extend perpendicularly-transverse to, and in partial overhanging relationship with respect to, the second belt system 76. The feeding table 110 includes a pair of elongate, parallel spaced, side walls 112, which are conventionally fixedly attached to the framework 30 above the level of the second belt system 76 so as to extend in the second direction 38 and thus perpendicularly-transverse to the first direction 34. In addition, the feeding table 110 includes a plurality of elongate, parallel-spaced, feed rollers 114, which are conventionally rotatably connected to the side walls 112. Preferably, the feed rollers 114 angularly extend between the side walls 112 for carrying envelopes 12 fed thereto in a path of travel 116 which extends downstream at an angle 118 of substantially ten degrees relative to the second direction 38. Further, the feeding table 110 comprises a third belt system 120 including a third pair of elongate, parallel-spaced, rollers 122, which are conventionally rotatably connected to the framework 30 beneath the respective feed rollers 114. The belt system 120 also includes a third endless belt 124 which is conventionally looped about and disposed in frictional engagement with the rollers 122, such that a third belt run 126 of the belt 124 generally extends in the direction of the path of travel 116 beneath the feed rollers 114. Moreover, the belt system 120 includes a plurality of pressure rollers 128 which are conventionally rotatably connected to the framework 30 at spaced intervals beneath the belt run 126 (FIG. 3) for urging successive portions of the belt run 126 upwardly between each successive pair of feed rollers 114, whereby the belt run 126 is urged into frictional engagement with the feed rollers 114. As thus constructed and arranged, the belt run 126 is sinuously supported by the pressure rollers 128 for driving each of the feed rollers 114, for feeding envelopes 12 (FIG. 1) fed to feed rollers 114 in the downstream path of travel 116 defined by the feed rollers 114.

In addition, the second envelope conveying structure 36 (FIG. 1) preferably comprises movable, envelope-edge registration structure 130, including an elongate frame 132, which is substantially coextensive in length with the feeding table 110 and is movably supported by the framework 30 in overhanging relationship with the feed rollers 114. The frame 132 includes an elongate, horizontally-extending, upper wall 134, and includes a depending side wall 136 which acts as a registration fence for envelopes 12 fed to the feeding table 110. Preferably the lower edge 138 (FIG. 3) of the side wall fence 136 is configured to extend between the respective feed rollers 114. To that end, the lower edge 138 has a plurality of arcuately-shaped notches 140 formed upwardly therein from the lower edge 138, at spaced intervals longitudinally of the length thereof, for receiving the respective feed rollers 114. In addition, for movably supporting the frame 132 (FIG. 1) the edge registration structure 130 includes a pair of elongate, parallel-spaced, slide bars 142, which are suitably fixedly attached to the framework 30, beneath the opposite ends of the frame 132, so as to extend transverse to the direction of movement of the frame 132. And, the registration structure 130 includes a plurality of conventional fasteners 144, such as a pair of thumb screws which are respectively threably connected to the opposite ends of the frame 132 (FIG. 3) for selectively locking the frame 132 to the slide bars 142, and unlocking the frame 132 from the slide bars 142, for selectively locating the frame 132 along the slide bars 142. As thus constructed and arranged, the frame 132, and thus the side wall fence 136, is angularly movable lengthwise of the rollers 114, and thus toward and away from the opposed side walls 112 of the feed table 110.

Moreover, the second conveying structure 32 (FIG. 1) includes second structure 150 for urging respective envelopes 12 into engagement with each of the feed rollers 114. The envelope urging structure 150 includes the frame 132, which includes a plurality of apertures 152 formed in the upper wall 134 at substantially equally spaced intervals longitudinally of the length thereof. Further, the second envelope urging structure 150 includes a plurality of collars 154, corresponding in number to the number of apertures 152, which are conventionally mounted within the respective apertures 152. And, the second urging structure 150 includes a plurality of spherically-shaped idler balls 156, corresponding in number to the number collars 154, which are conventionally removably located within the respective collars 154 and rotatably held in place thereby in engagement with the respective feed rollers 114 therebeneath. As thus constructed and arranged, when the respective feed rollers 114, feed each envelope 12 downstream beneath the frame 132, the envelope 12 is serially fed beneath each idler ball 156, against the normal force exerted thereby on the envelope 12. As a result, the idler balls 156 tend to urge successive envelopes 12 into positive engagement with each of the feed rollers 114, independently of any difference there may be in the thickness of the envelopes 12. Moreover, the idler balls 156 tend to prevent envelopes 12 which are fed therebeneath and into engagement with the side wall registration fence 136, from bouncing away from the fence 136 as they are carried downstream by feed rollers 114. Thus the envelope urging structure 150 tends to promote accurate registration of successive envelopes 12 against the side wall fence 136, and thus accurate alignment of the envelopes 12 in the second direction 38, as they are fed downstream by the feed rollers 114.

The envelope reorienting structure 40 (FIG. 1) preferably includes a first, elongate, idler roller 160, which is conventionally rotatably connected to the framework 30, beneath the level of the path of travel 64 of envelopes 12 fed by the first conveying structure 32, so as to horizontally extend at an angle 65 of forty-five degrees with respect to each of the first and second directions, 34 and 38. In addition, the reorienting structure 40 includes a second, elongate, feed roller 162, which is conventionally rotatably connected to the framework 30, substantially midway between the levels of the paths of travel, 64 and 116, of envelopes 12 fed by the first and second conveying structures, 32 and 36, so as to horizontally extend parallel to the first idler roller 160, and thus at angles 65 of forty-five degrees with respect to both the first and second directions, 34 and 38. And the reorienting structure 40 includes a third, elongate, idler roller 164, which is conventionally rotatably connected to the framework 30, above the level of the path of travel 116 of envelopes 12 fed by the second conveying structure 36, so as to horizontally extend parallel to the second roller 162, and thus at angles 65 of forty-five degrees with respect to both the first and second directions, 34 and 38. Moreover, the respective axis of rotation of the rollers, 160, 162 and 164, preferably lie in a vertical plane extending at an angle 65 of forty-five degrees with respect to the first and second directions, 34 and 38. Further, the rollers, 160, 162 and 164, are preferably relatively dimensioned such that the first idler roller 160 and second feed roller 162 define a first, lower nip 166 at the level of the path of travel 34 of envelopes 12 fed by the first conveying structure 32, and such that the second feed roller 162 and third idler roller 164 define a second, upper nip 168 at the level of envelopes 12 fed by the second conveying structure 36.

In addition, the envelope reorienting structure 40 (FIG. 1) includes envelope guiding structure 170 including an elongate member 172 which is conventionally connected to the framework 30 (FIG. 2) so as to extend alongside the rollers, 160, 162 and 164, downstream, relative to the first direction 36, from the nip 166 between the rollers, 162 and 164. The member 172, includes an elongate surface 174, which is arcuately-shaped in transverse cross-section and is disposed in facing relationship with the feed roller 162 so as to define an arcuately-shaped channel 176 with the periphery of the feed roller 162. The channel 176 arcuately extends between the lower nip 166 and upper nip 168 for guiding envelopes 12 fed by the rollers, 160, 162 and 164, in the arcuately-extending path of travel 42 between the lower and upper nips, 166 and 168. Thus the lower edge 178 of the surface 174 extends parallel to but below the level of the lower nip 166, to ensure that envelopes 12 fed to the lower nip 166 are fed into engagement with the surface 174, and the upper edge 180 of the surface 174 extends parallel to but above the level of the upper nip 168, to ensure that envelopes 12 in the path of travel 42 are guided by the surface 174 to the upper nip 168.

For driving the envelope transporting apparatus 10 (FIG. 1) the apparatus generally includes a conventional motor 190, such as a d.c. motor. In addition the apparatus 10 includes a conventional gear system 192, which is suitably connected to the motor 190 for driving thereby. Preferably, the gear system 192 is conventionally connected to one of the rollers 58 for driving the first belt system 56, to one of the rollers 78 for driving the second belt system 76, to one of the rollers 122 for driving the third belt system 120 and thus the rollers 114 of the feed table 110, and the feed roller 162 for driving the envelope reorienting structure 40, in timed relationship with one another. Moreover the apparatus 10 includes conventional motor control structure 194, including for example a conventional source of supply of power, and a suitable microprocessor having a conventional motor driving circuit and keyboard connected thereto, which are suitably connected to the motor 190 for controlling energization and deenergization of the motor 190 and thus the envelope transporting apparatus 10.

In practice, envelopes 12 (FIG. 1) may be successively fed, one at a time, to the first envelope conveying structure 32 from any suitable envelope feeding structure 196 which is constructed and arranged for feeding envelopes 12 from a stack thereof in a manner such that the front, or address, wall portion 16 of the body 14 of the envelope 12 is oriented upwardly, with the flap wall portion 22 extending generally horizontally therefrom, and such that the bottom edge 20 of the body 14 of the envelope 12 is the leading edge thereof and the flap wall portion 22 trails the body 14.

As the envelopes 12 (FIG. 1) are successively fed from the feeding structure 196 to the first conveying structure 2, each of the envelopes 12 is received on the first belt system 56 and carried by the first belt run 62 thereof in the path of travel 64 beneath, and against the normal force exerted by, the idler balls 100, and into engagement with the registration fence 70, whereby one of the side fold edges 26 of each envelope 12 is urged into engagement with the fence 70 and the envelope 12 is aligned therewith for feeding downstream in the first direction 34 to the second belt system 76.

As each of the envelopes 12 (FIG. 1) fed to the second belt system 76 is received thereby, the envelope 12 is carried by the second belt run 82 thereof downstream in the first direction 34 to the envelope reorienting structure 40 and fed into the lower nip 166 (FIG. 2) between the idler and feed rollers 162 and 164. Whereupon the feed roller 162 progressively feeds the respective envelopes 12 downstream relative to the first direction 34 and into engagement with the arcuately-extending guide surface 174, then arcuately upwardly in the path of travel 42 within the channel 176 and into the upper nip 168 between the idler and feed rollers, 160 and 162, and then, at an angle of forty-five degrees with respect to the second direction 38, to the second conveying structure 36. In the course of passage through the channel 176, the envelopes 12 are progressively reoriented, that is, the upwardly oriented front and flap wall portions, 16 and 22, of the envelopes 12 are progressively downwardly oriented.

As the envelopes 12 (FIG. 1) are successively fed from the reorienting structures 40 to the second conveying structure 36, each of the envelopes 12 is received on the feed roller table 110 and carried by the feed rollers 114 thereof in the path of travel 116 beneath, and against the normal force exerted by, the idler balls 156, and into engagement with the side wall registration fence 136, whereby the same side fold edge 26 of each envelope 12 which was urged into engagement with the registration fence 70 is also urged into engagement with the side wall registration fence 136, and the envelope 12 is aligned therewith for feeding downstream in the second direction 38 from the second conveying structure 36. As a result, the side edge 26 of each envelope 12 which is opposite to the side edge 26 disposed in engagement with the side wall registration fence 136, is aligned with a reference line 196 extending parallel to the fence 136 and thus in the second direction 38. Moreover, it is noted that since the registration fence structure 130 is constructed and arranged for movement toward and away from the reference line 196, envelopes 12 of differing dimensions, for example those having longer or shorter bottom and crease edges, 20 and 24, than the envelopes 12 shown in FIGS. 1 and 2, may be aligned with the same references line 196, to facilitate stuffing inserts of varying dimensions into envelopes 12 of different sizes.

In practice the apparatus 10 comprises an inserter wherein envelopes 12 from the feed table 110 may be successively fed, one at a time, to any conventional envelope stuffing structure 200 which is constructed and arranged for receiving, and opening and stuffing inserts into, successive envelopes 12 which are oriented in a manner such that the front and flap wall portions, 16 and 22, of each envelope 12 are oriented downwardly, and such that the bottom edge 20 of the body 20 of the envelope 12 is the leading edge thereof and the flap wall portion 22 trails the body 20.

In accordance with the objects of the invention there has been described envelope transporting apparatus including structure for reorienting an envelope, for example, for use in applications wherein reliable, high speed, envelope feeding and stuffing functions are to be facilitated.

What is claimed is:

1. Apparatus for transporting an envelope including a body having opposed front and back wall portions defining a bottom edge, wherein the envelope includes a flap wall portion extending from the front wall portion and defining therewith a crease edge extending parallel to the bottom edge for folding the flap wall portion in overlaying relationship with the back wall portion, and wherein the front and back wall portions define parallel-spaced side edges extending between the creases and bottom edges, the apparatus comprising:

a. first means for conveying the envelope in a first direction wherein the front and flap wall portions thereof are upwardly oriented, the first conveying means including first means for aligning one envelope side edge in the first direction;

b. second means for conveying the envelope in a second direction wherein the front and flap wall portions thereof are downwardly oriented, the second conveying means including second means for aligning the one envelope side edge in the second direction; and c. means for reorienting the envelope, the reorienting means including means for guiding the envelope through a curvedly-extending path of travel wherein the upwardly oriented front and flap wall portions are progressively downwardly oriented, the guiding means including an elongate member having a guide surface which is arcuately-shaped in transverse cross-section, the reorienting means including first means for feeding the envelope from the first conveying means to the guiding means, and the reorienting means including second means for feeding the envelope from the guiding means to the second conveying means.

2. The apparatus according to claim 1, wherein the first conveying means includes a belt and a pair of parallel-spaced rollers about which the belt is endlessly looped, the first conveying means including means for driving one of the rollers, and the first aligning means including a stationary registration fence extending in the first direction.

3. The apparatus according to claim 2, wherein the belt includes a belt run oriented at an acute angle relative to the first direction for guiding the one side edge into engagement with the registration fence.

4. The apparatus according to claim 1, wherein the second conveying means includes a plurality of elongate parallel-spaced rollers, the second conveying means including means for driving the rollers, and the second aligning means including a movable registration fence extending in the second direction.

5. The apparatus according to claim 4, wherein the rollers are respectively oriented at an acute angle relative to the second direction for guiding the one side edge into engagement with the movable registration fence.

6. The apparatus according to claim 1, wherein the second direction extends perpendicularly transverse to the first direction.

7. The apparatus according to claim 1, wherein the first feeding means includes first and second elongate parallel-spaced rollers, the second feeding means including the second roller and a third elongate roller extending parallel thereto, and the reorienting means including means for driving one of the rollers.

8. The apparatus according to claim 1, wherein the apparatus is an inserter.

9. The apparatus according to claim 1, wherein the first direction is a downstream direction, and the envelope is conveyed downstream in said first direction such that the bottom edge thereof is downstream relative to the crease edge thereof.

10. The apparatus according to claim 1, wherein the first conveying means extends beneath the second conveying means, and the curvedly-extending path of travel extends upwardly between the first and second conveying means.

11. The apparatus according to claim 1, wherein the second aligning means is movable toward and away from a reference line extending in the second direction, and the aligning means aligning the one side edge of the envelope for aligning the opposite side edge thereof with the reference line.

12. The apparatus according to claim 4, wherein the registration fence is selectively positionable relative to a reference line extending in the second direction, and the rollers guide the one side edge into engagement with the registration fence for aligning the opposite side edge of the envelope with the reference line.

13. The apparatus according to claim 1 including means for feeding the envelope to the first conveying means, and the apparatus including means for opening the envelope fed from the second conveying means and stuffing inserts into the opened envelope.

14. Apparatus for transporting an envelope including a body having opposed front and back wall portions defining a bottom edge, wherein the envelope includes a flap wall portion extending from the front wall portion and defining therewith a crease edge extending parallel to the bottom edge for folding the flap wall portion in overlaying relationship with the back wall portion, and wherein the front and back wall portions define parallel-spaced side edges extending between the crease and bottom edges, the apparatus comprising:

a. first means for conveying the envelope in a first direction wherein the front and flap wall portions thereof are upwardly oriented, the first conveying means including first means for aligning one envelope side edge in the first direction;

b. second means for conveying the envelope in a second direction wherein the front and flap wall portions thereof are downwardly oriented, the second conveying means including second means for aligning the one envelope side edge in the second direction, the second aligning means movable toward and away from a reference line extending in the second direction, the aligning means aligning the one side edge of the envelope for aligning the opposite side edge thereof with the reference line; and c. means for reorienting the envelope, the reorienting means including means for guiding the envelope through a curvedly-extending path of travel wherein the upwardly oriented front and flap wall portions are progressively downwardly oriented, the reorienting means including first means for feeding the envelope from the first conveying means to the guiding means, and the reorienting means including second means for feeding the envelope from the guiding means to the second conveying means.

15. The apparatus according to claim 14, wherein the apparatus is an inserter.

16. The apparatus according to claim 14, wherein the first conveying means includes a belt and a pair of parallel-spaced rollers about which the belt is endlessly looped, the first conveying means including means for driving one of the rollers, and the first aligning means including a stationary registration fence extending in the first direction.

17. The apparatus according to claim 16, wherein the belt includes a belt run oriented at an acute angle relative to the first direction for guiding the one side edge into engagement with the registration fence.

18. The apparatus according to claim 14, wherein the second conveying means includes a plurality of elongate parallel-spaced rollers, the second conveying means including means for driving the rollers, and the second aligning means including a movable registration fence extending in the second direction.

19. The apparatus according to claim 18, wherein the rollers are respectively oriented at an acute angle relative to the second direction for guiding the one side edge into engagement with the movable registration fence.

20. The apparatus according to claim 14, wherein the second direction extends perpendicularly transverse to the first direction.

21. The apparatus according to claim 14, wherein the first feeding means includes first and second elongate parallel-spaced rollers, the second feeding means including the second roller and a third elongate roller extending parallel thereto, and the reorienting means including means for driving one of the rollers.

22. The apparatus according to claim 14, wherein the first direction is a downstream direction, and the envelope is conveyed downstream in said first direction such that the bottom edge thereof is downstream relative to the crease edge thereof.

23. The apparatus according to claim 14, wherein the first conveying means extends beneath the second conveying means, and the curvedly-extending path of travel extends upwardly between the first and second conveying means.

24. The apparatus according to claim 18, wherein the registration fence is selectively positionable relative to the reference line, and the rollers guide the one side edge into engagement with the registration fence for aligning the opposite side edge of the envelope with the reference line.

25. The apparatus according to claim 14, including means for feeding the envelope to the first conveying means, and the apparatus including means for opening the envelope fed from the second conveying means and stuffing inserts into the opened envelope.

26. Apparatus for transporting an envelope including a body having opposed front and back wall portions defining a bottom edge, wherein the envelope includes a flap wall portion extending from the front wall portion and defining therewith a crease edge extending parallel to the bottom edge for folding the flap wall portion in overlaying relationship with the back wall portion, and wherein the front and back wall portions define parallel-spaced side edges extending between the crease and bottom edges, the apparatus comprising:

a. first means for conveying the envelope in a first direction wherein the front and flap wall portions thereof are upwardly oriented, the first conveying means including first means for aligning one envelope side edge in the first direction;

b. second means for conveying the envelope in a second direction wherein the front and flap wall portions thereof ar downwardly oriented, the second conveying means including second means for aligning the one envelope side edge in the second direction, the second aligning means including a registration fence selectively positionable relative to a reference line extending in the second direction, the second conveying means including a plurality of rollers for guiding the one side edge into engagement with the registration fence to align the opposite side edge of the envelope with the reference line; and c. means for reorienting the envelope, the reorienting means including means for guiding the envelope through a curvedly-extending path of travel wherein the upwardly oriented front and flap wall portions are progressively downwardly oriented, the reorienting means including first means for feeding the envelope from the first conveying means to the guiding means, and the reorienting means including second means for feeding the envelope from the guiding means to the second conveying means.

27. The apparatus according to claim 26, wherein the apparatus is an inserter.

28. The apparatus according to claim 26, wherein the first conveying means includes a belt and a pair of parallel-spaced rollers about which the belt is endlessly looped, the first conveying means including means for driving one of the rollers, and the first aligning means including a stationary registration fence extending in the first direction.

29. The apparatus according to claim 28, wherein the belt includes a belt run oriented at an acute angle relative to the first direction for guiding the one side edge into engagement with the registration fence.

30. The apparatus according to claim 26, wherein the second conveying means includes means for driving the rollers.

31. The apparatus according to claim 30, wherein the rollers are respectively oriented at an acute angle relative to the second direction for guiding the one side edge into engagement with the registration fence.

32. The apparatus according to claim 26, wherein the second direction extends perpendicularly transverse to the first direction.

33. The apparatus according to claim 26, wherein the first feeding means includes first and second elongate parallel-spaced rollers, the second feeding means including the second roller and a third elongate roller extending parallel thereto, and the reorienting means including means for driving one of the rollers.

34. The apparatus according to claim 26, wherein the first direction is a downstream direction, and the envelope is conveyed downstream in said first direction such that the bottom edge thereof is downstream relative to the crease edge thereof.

35. The apparatus according to claim 26, wherein the first conveying means extends beneath the second conveying means, and the curvedly-extending path of travel extends upwardly between the first and second conveying means.

36. The apparatus according to claim 26 including means for feeding the envelope to the first conveying means, and the apparatus including means for opening the envelope fed from the second conveying means and stuffing inserts into the opened envelope.

* * * * *